US008595957B2

(12) United States Patent
McDowell et al.

(10) Patent No.: US 8,595,957 B2
(45) Date of Patent: Dec. 3, 2013

(54) UNITARY UPPER AND MIDSOLE

(75) Inventors: Sean Michael McDowell, Andover, MA (US); Christopher L. Edington, Portland, OR (US)

(73) Assignee: Converse Inc., North Andover, MA (US)

( * ) Notice: Subject to any disclaimer, the term of this patent is extended or adjusted under 35 U.S.C. 154(b) by 292 days.

(21) Appl. No.: 12/983,573

(22) Filed: Jan. 3, 2011

(65) Prior Publication Data

US 2012/0167417 A1 Jul. 5, 2012

(51) Int. Cl.
*A43C 11/00* (2006.01)

(52) U.S. Cl.
USPC ..... 36/50.1; 36/45

(58) Field of Classification Search
USPC ..... 36/45, 107, 103, 102, 15, 25 R, 50.1
See application file for complete search history.

(56) References Cited

U.S. PATENT DOCUMENTS

| | | | | |
|---|---|---|---|---|
| 4,438,574 | A | 3/1984 | Johnson | |
| D515,299 | S * | 2/2006 | Burg | D2/969 |
| 7,010,872 | B2 * | 3/2006 | Pawlus et al. | 36/100 |
| 7,287,342 | B2 | 10/2007 | Keen | |
| 7,347,012 | B2 | 3/2008 | Clark et al. | |
| 7,421,805 | B2 | 9/2008 | Geer | |
| 7,513,064 | B2 | 4/2009 | Fuerst | |
| 7,591,084 | B2 * | 9/2009 | Santa Ana | 36/100 |
| 7,631,440 | B2 * | 12/2009 | Keen et al. | 36/50.1 |
| 8,181,363 | B2 * | 5/2012 | Klein | 36/100 |
| 8,196,320 | B2 * | 6/2012 | Adami et al. | 36/100 |
| 2003/0182820 | A1 * | 10/2003 | Fuerst et al. | 36/11.5 |
| 2004/0128863 | A1 * | 7/2004 | Hong et al. | 36/100 |
| 2004/0226192 | A1 | 11/2004 | Geer et al. | |
| 2007/0011910 | A1 | 1/2007 | Keen | |
| 2007/0011911 | A1 | 1/2007 | Clerk et al. | |
| 2007/0011912 | A1 | 1/2007 | Clark et al. | |
| 2007/0011914 | A1 | 1/2007 | Keen et al. | |
| 2008/0047165 | A1 | 2/2008 | Keen | |
| 2009/0265955 | A1 | 10/2009 | Fuerst | |

OTHER PUBLICATIONS

Notification of Transmittal of the International Search Report and the Written Opinion of the International Searchign Authority, or the Declaration, in PCT/US11/063927 dated Apr. 13, 2012, 14 pages.

* cited by examiner

*Primary Examiner* — Jila M Mohandesi
(74) *Attorney, Agent, or Firm* — Shook, Hardy & Bacon L.L.P.

(57) ABSTRACT

Embodiments of the present invention relate to an article of footwear having a unitary upper and midsole referred to as a midsole-upper. The midsole-upper includes both a midsole portion and an upper portion. An outsole may be coupled to the midsole portion to provide a ground contacting surface. Additionally, a bootie may be coupled to the interior of the midsole-upper. A reinforcement may be utilized in conjunction with the midsole-upper and/or the bootie to resist lasting deformation of apertures formed into the midsole-upper for a lacing structure. The reinforcement may be coupled to the bootie, the midsole-upper, or other portions of the shoe. In an embodiment, the reinforcements are constructed from a material different from that which the midsole-upper is formed. Consequently, a traditional crisscross lacing pattern may be utilized while still realizing benefits of having a unitary upper and midsole.

20 Claims, 6 Drawing Sheets

UNITARY UPPER AND MIDSOLE

BACKGROUND

A shoe is typically constructed having a sole having an outsole, a midsole, and an insert. A shoe is also typical constructed with an upper attached to the sole of the shoe. The upper is typically manufactured from a flexible material such as leather or canvas, while the sole is constructed from a more impact attenuating material than the upper (e.g., rubber). However, the process of affixing the upper to the sole is a potentially laborious and difficult task for a traditional shoe. Additionally, errors and other unintentional results may occur during this joining of the sole and upper. Further, a junction that is created between the upper and the sole may provide discomfort to a wearer and/or may produce a weak portion of the resulting typical shoe.

SUMMARY

Embodiments of the present invention relate to an article of footwear having a unitary upper and midsole, which is referred to as a midsole-upper herein. The midsole-upper includes both a midsole portion and an upper portion. An outsole may be coupled to the midsole portion providing a ground contacting surface. Additionally, a bootie may be coupled to the interior of the midsole-upper near the upper portion and/or the interior surface of the midsole portion. A reinforcement may be utilized at the midsole-upper and/or the bootie to resist a lasting deformation of apertures formed into the midsole-upper for a lacing structure. In an embodiment, the reinforcements are constructed from a material different from that which the midsole-upper is formed. Consequently, a traditional crisscross lacing pattern may be utilized while still realizing benefits of having a unitary upper and midsole, the midsole-upper.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
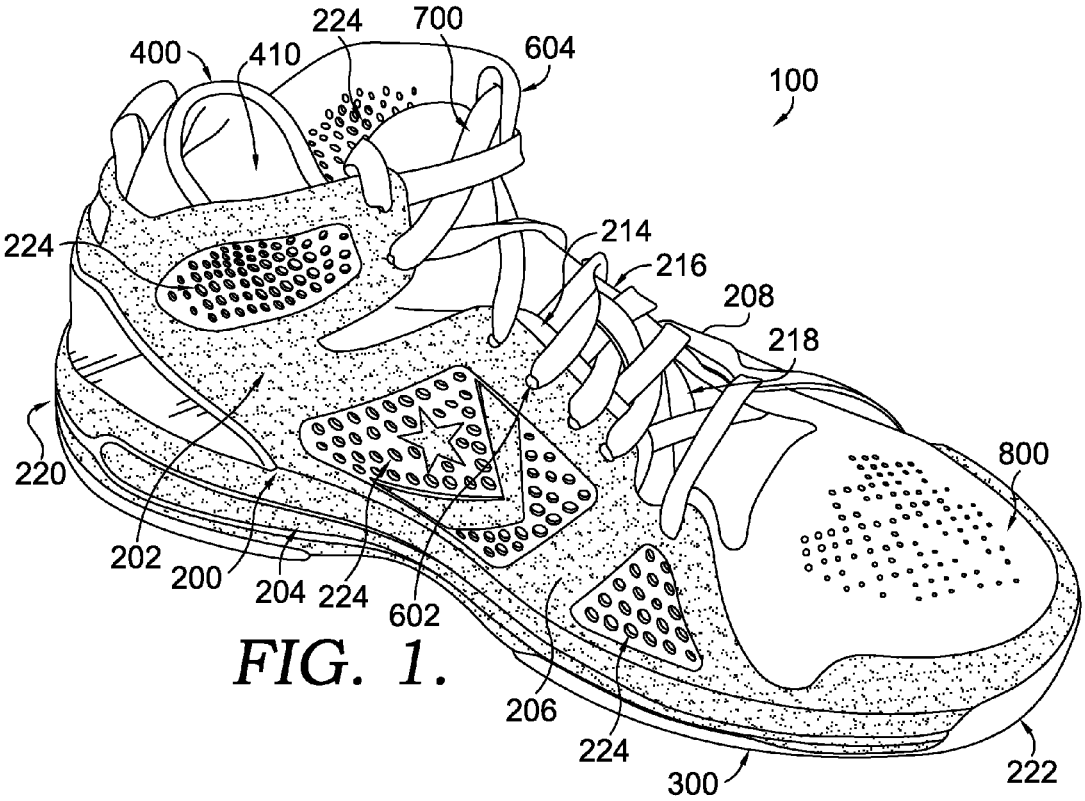
FIG. 1 depicts a medial perspective view of an exemplary shoe having a midsole-upper, in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to an article of footwear having a unitary upper and midsole referred to as a midsole-upper. The midsole-upper includes both a midsole portion and an upper portion. An outsole may be coupled to the midsole portion to provide a ground contacting surface. Additionally, a bootie may be coupled to the interior of the midsole-upper near the upper portion and/or the interior surface of the midsole portion. A reinforcement may be utilized at the midsole-upper and/or the bootie to resist a lasting deformation of apertures formed into the midsole-upper for a lacing structure. In an embodiment, the reinforcements are constructed from a material different from that which the midsole-upper is formed. Consequently, a traditional crisscross lacing pattern may be utilized while still realizing benefits of having a unitary upper and midsole, the midsole-upper.

Accordingly, in one aspect, the present invention provides an article of footwear having an outsole with a bottom surface for contacting the ground and an opposite top surface. The footwear is also comprised of a unitary upper and midsole ("midsole-upper") of flexible material having an upper portion and a midsole portion. The midsole-upper has a medial side with a first aperture, an opposite lateral side with a second aperture, a heel end, and an opposite toe end. A bottom surface of the midsole portion is attached to the top surface of the outsole. Additionally, the footwear is comprised of a bootie. A bottom outside surface of the bootie is attached to the interior surface of the midsole-upper (e.g., the top surface of the midsole portion). The footwear is also comprised of reinforcements that are near the apertures of the midsole-upper. The reinforcements are formed from a material different from the flexible material of the midsole-upper, which prevents a lacing structure extending through the apertures of the midsole-upper from deforming the apertures.

A second aspect of the present invention provides an additional embodiment of an article of footwear. The footwear includes a unitary upper and midsole (again, referred to as a "midsole-upper") of a first flexible material having a medial side, a lateral side, a toe end, and a heel end. The midsole-upper has an upper portion and a midsole portion, such that the upper portion is formed to surround a medial and a lateral portion of a received foot. Further, the midsole portion has a superior surface formed to provide a support platform for the foot and the midsole portion also has an opposite inferior (bottom) surface. The footwear also includes an outsole of flexible material that is different from the material of the midsole-upper. The outsole is coupled to the inferior surface of the midsole portion of the midsole-upper. The footwear also includes a bootie of a flexible material that is different from the first flexible material used to construct the midsole-upper. The bootie is attached to the midsole-upper near the heel end of the midsole-upper. Additionally, the midsole-upper includes a medial reinforcement and a lateral reinforcement that are constructed from a material different from the first flexible material of the midsole-upper. The footwear also includes a lacing structure extending across a forefoot opening between the medial side of the midsole-upper and the lateral side of the midsole-upper. The lacing structure is able to extend through the medial side of the midsole-upper, the medial reinforcement, the lateral reinforcement and the lateral side of the midsole-upper.

A third aspect of the present invention provides an additional embodiment of an article of footwear. The footwear includes a unitary upper and midsole (which again is referred to as a "midsole-upper") of a molded material having a toe end and an opposite heel end. The midsole-upper also has opposite medial and lateral sides extending between the toe end and the heel end. The medial side extends upwardly from a midsole portion to form a medial side edge. The lateral side extends upwardly from the midsole portion to form a lateral side edge. The medial side edge and the lateral side edge define a forefoot opening of the footwear. The medial side includes a first set of apertures (e.g., eyelets) extending along a portion of the medial side edge. Similarly, the lateral side includes a second set of apertures extending along a portion of the lateral side edge. The footwear also includes a bootie of a flexible woven material. An outer surface of the bootie and an inner surface of the midsole-upper are coupled together near the midsole-upper heel end. The bootie extends across the forefoot opening of the footwear. The footwear also includes a medial reinforcement positioned between the outer surface of the bootie and the inner surface of the midsole-upper near the first set of apertures of the midsole-upper. Similarly, the midsole-upper includes a lateral reinforcement positioned between the outer surface of the bootie and the inner surface of the midsole-upper near the second set of apertures of the midsole-upper. The medial reinforcement and the lateral reinforcement are formed from a different material than the midsole-upper. The footwear also includes a lacing structure crossing from the first set of apertures to the second set of apertures across the forefoot opening such that the lacing structure extends through both the medial reinforcement and the lateral reinforcement after extending through the first set of apertures and before extending through the second set of apertures.

Having briefly described an overview of embodiments of the present invention, a more detailed description follows.

The construction of an exemplary article of footwear ("shoe") 100 of the present invention has the basic construction of a traditional shoe. However, the shoe 100 is comprised of a unitary upper and midsole 200, which is referred to herein as a "midsole-upper." The midsole-upper 200 includes an upper portion 202 and a midsole portion 204. Unlike a traditional shoe that has a discrete upper and a discrete midsole that are bonded together during an assembly process, the midsole-upper 200 may be injection molded to form a cohesive unit/component that includes both the upper portion 202 and the midsole portion 204. The shoe 100 also is comprised of a medial reinforcement and a lateral reinforcement, which may either be coupled to a bootie 400 in an exemplary embodiment or to the midsole-upper 200 in an additional exemplary embodiment. Other positions for the reinforcement are contemplated herein. The reinforcement provides protection to one or more apertures located in the midsole-upper 200 through which a lacing structure 700 may pass.

In embodiments, the shoe 100 is a high-top basketball-style shoe. However, it should be understood that the novel concept of the invention could be employed on other types of shoes (e.g., low-top, infant, toddler, children, adult, cross-training, running, lifting, and the like). Because much of the construction of the shoe 100 is the same as that of a conventional shoe, the conventional features of the constructions will be described only generally herein.

The shoe 100 has a shoe outsole 300 that is constructed of resilient materials that are typically employed in the construction of outsoles of athletic shoes. For example, a synthetic or natural rubber may be used to form the outsole 300 in an exemplary embodiment. As is typical in a traditional shoe, the outsole 300 may include treads or other traction-gaining formations on an inferior surface 302. The inferior surface 302 traditionally contacts the ground or other surfaces for which the shoe 100 is intended to be used. For example, the term "ground" may include a court, a pitch, a field, a track, a mat, a floor, and the like. Therefore, to provide a relational understanding of the orientation of one or more surfaces discussed herein, a general term of the ground may imply any contacting surface for which the bottom of the outsole is intended to contact.

Figure 10:
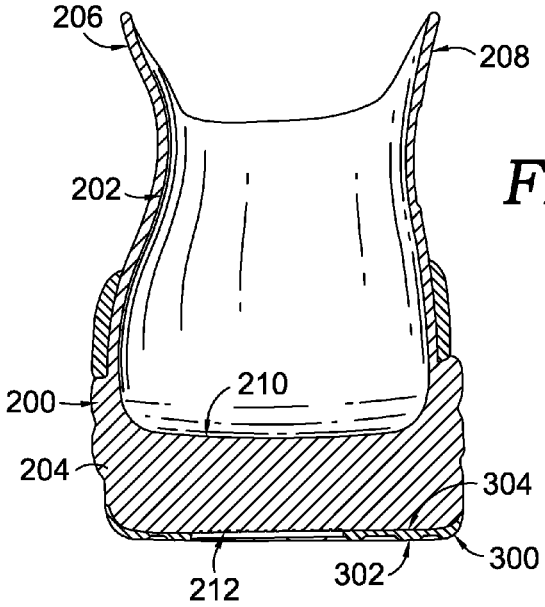
FIG. 10 depicts a cross sectional view of an exemplary midsole-upper and outsole taken along line 10-10 in FIG. 9, in accordance with an embodiment of the present invention.

The outsole 300 may be coupled to the midsole-upper 200 utilizing a number of techniques. For example, a second surface 304 of the outsole 300, which is opposite of the inferior surface 302 (bottom of the outsole 300), may be adhered to an inferior surface 212 of the midsole-upper 200 (as best seen in FIG. 10). Similarly, it is contemplated that the outsole 300 is coupled to at least a portion of the midsole-upper 200 utilizing a glue/adhesive, a bonding agent, chemical welding, ultrasonic welding, stitching, mechanical fasteners, and/or the like.

Figure 5:
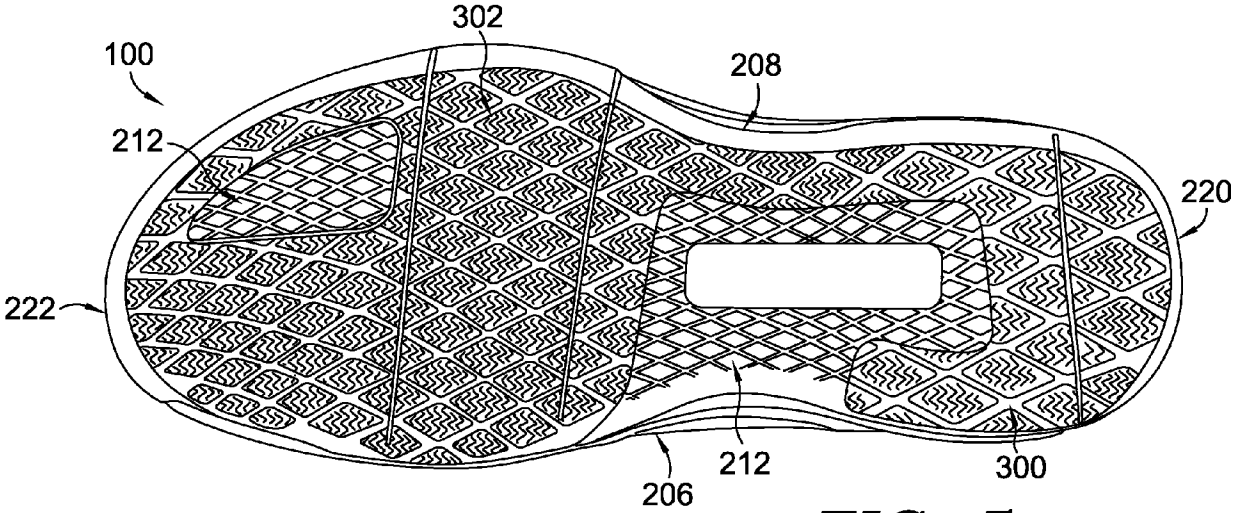
FIG. 5 depicts bottom view of an exemplary shoe constructed with a midsole-upper, in accordance with an embodiment of the present invention.

It is also contemplated that in exemplary embodiments of the present invention the outsole 300 may include one or more voids allowing a portion of the inferior surface 212 of the midsole-upper 200 to be exposed through the outsole 300 to the ground. For example, as depicted in FIG. 5, portions of the inferior surface 212 are exposed through the outsole 300. In an exemplary aspect, the exposing of the inferior surface 212 may be desired to provide an alternative coefficient of friction from that which is provided by the inferior surface 302 of the outsole 300. For example, as will be discussed in more detail hereinafter, it is contemplated that the midsole-upper 200 is formed from a different material than the outsole 300; therefore, it is further contemplated that a different coefficient of friction may be supplied by alternative materials being exposed to the ground. Additionally, it is contemplated that alternative impact attenuation characteristics may be gained by exposing a portion of the midsole-upper 200 through the outsole 300. Further yet, rigidity of the shoe 100 may be adjusted in both a lateral direction (side to side) and/or longitudinally (front to back) based on the location and shape of one or more voids (or changes in thickness) of the outsole 300.

Further, it is contemplated that the shoe 100 is constructed such that a typical outsole is not coupled with the midsole-upper 200. Instead, it is contemplated that the inferior surface 212, at least in part, forms the ground contacting surface for the shoe 100. For example, it is contemplated that in an exemplary embodiment, the inferior surface 212 forms the ground contacting surface for the shoe 100, which may eliminate the need for an outsole 300.

As is conventional with a shoe, an insert may also be included with the shoe 100. The insert (not pictured) may be included within the outsole 300, the midsole-upper 200, and/or inserted above, below, or in between any of the features discussed herein.

The size of the shoe 100 has a length that extends from a rear heel end 220 to a front toe end 222 of the midsole-upper 200. As best seen in FIG. 5, the shoe 100 has a width that extends between a medial side 206 and a lateral side 208 of the midsole-upper 200.

The shoe 100 also is constructed with the midsole-upper 200. A midsole-upper may also be referred to as a unibody, a shell, a monocoque, or a structural support skin. For example, as will be discussed in more detail hereinafter, a monocoque may provide the necessary structural support as a unitary body that would traditionally be provided by a combination of discrete elements, such as a midsole and an upper.

The midsole-upper 200 extends upwardly from the outsole 300, such as from the outsole second surface 304. The midsole-upper 200 is constructed of a flexible material. In an exemplary embodiment of the present invention, the midsole-upper 200 is formed from a resilient material such as ethyl vinyl acetate ("EVA") or polyurethane ("PU") foams or other such materials. For example, it is contemplated that a midsole-upper 200 is formed from an injection molding process utilizing EVA to form the midsole-upper 200 having the midsole portion 204 and the upper 202 as a unitary element. The midsole-upper 200 is constructed with a heel portion that extends around a received foot at the heel end 220. The heel portion of the upper portion 202 extends upwardly from the midsole portion 204 to an ankle opening. The ankle opening provides access to the shoe interior. The midsole-upper 200 has an interior surface and an exterior surface. The interior surface of the midsole-upper 200 is traditionally exposed to the wearer's foot or the bootie 400. The exterior surface is traditionally exposed to the outside environment and may define a portion of the exterior of the shoe 100.

From the heel portion of the upper portion 202, the midsole-upper 200 has a medial side 206 and a lateral side 208. The medial side 206 extends upwardly from the midsole portion 204 to a medial side edge 214. The lateral side portion 208 extends upwardly from the midsole portion 204 to a lateral side edge 216. As illustrated in the figures, the medial side edge 214 and the lateral side edge 216 extend rearwardly from opposite sides of the front toe end 222 toward the ankle opening. As seen in FIG. 1, the length of the medial side edge 214 and the lateral side edge 216 define a forefoot opening 218 in the midsole-upper 200 that may open to the shoe interior.

The shoe 100 may also be constructed with a toe box 800 (as seen in FIG. 1) that extends around and across a superior surface 210 of the midsole portion 204 at the toe end 222. The toe box 800 is connected between the medial side 206 and the lateral side 208 and encloses a portion of the shoe interior adjacent the toe end 222. The medial side edge 214 and the lateral side edge 216 extend rearwardly from the toe box 800 in an exemplary embodiment. It is contemplated that the toe box 800 may be constructed from a flexible material. For example, the toe box 800 may be formed as part of the midsole-upper 200 resulting in the toe box 800 being constructed from the same material as the midsole-upper 200. The toe box 800 may also be constructed from a material that is different from that which is used to form the midsole-upper 200. It is contemplated that the toe box 800 is constructed from natural or synthetic leather, a fabric (e.g., canvas), polymer, or other flexible materials. Additionally, it is contemplated that the toe box 800 is coupled with the midsole-upper 200, the bootie 400, or any combination of the features discussed herein.

Figure 2:
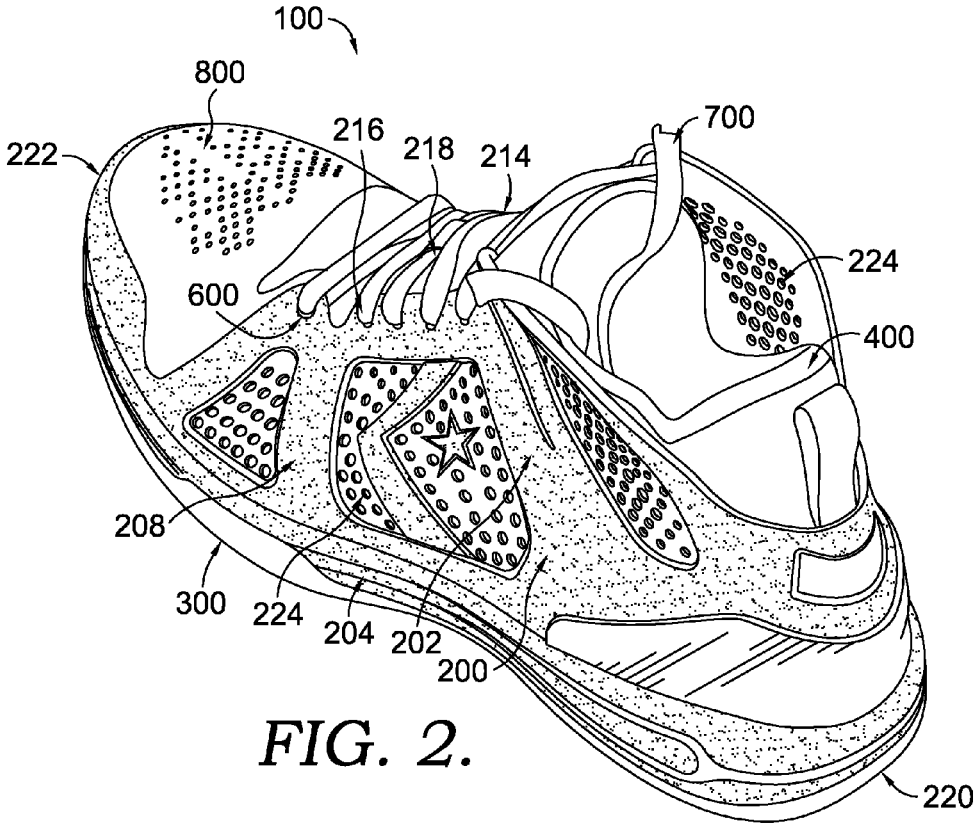
FIG. 2 depicts a lateral perspective view of an exemplary shoe having a midsole-upper, in accordance with an embodiment of the present invention.
Figure 3:
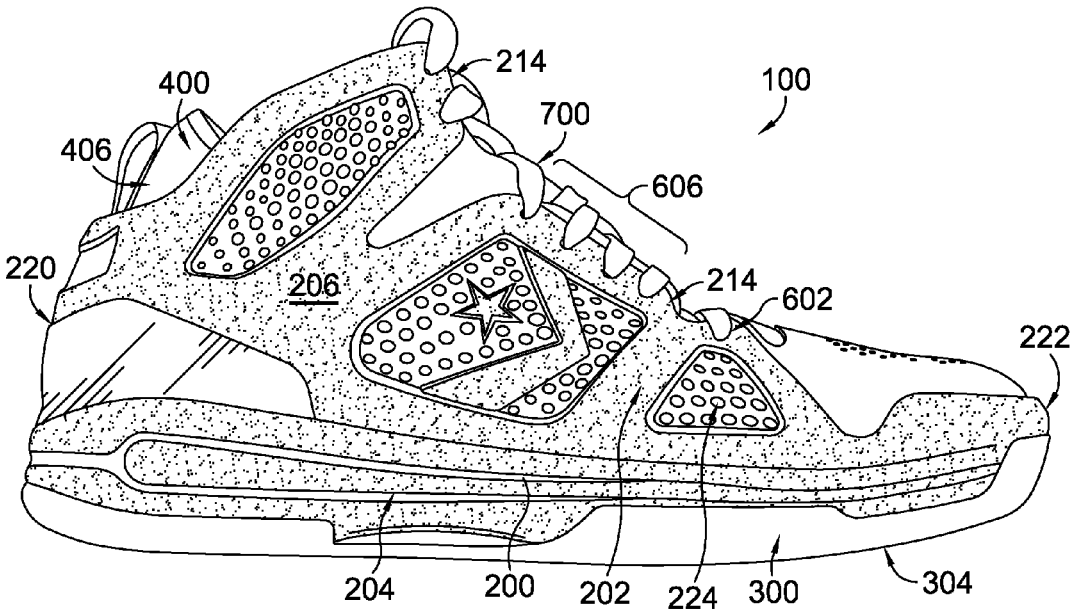
FIG. 3 depicts a medial view of an exemplary shoe constructed with a midsole-upper, in accordance with an embodiment of the present invention.
Figure 4:
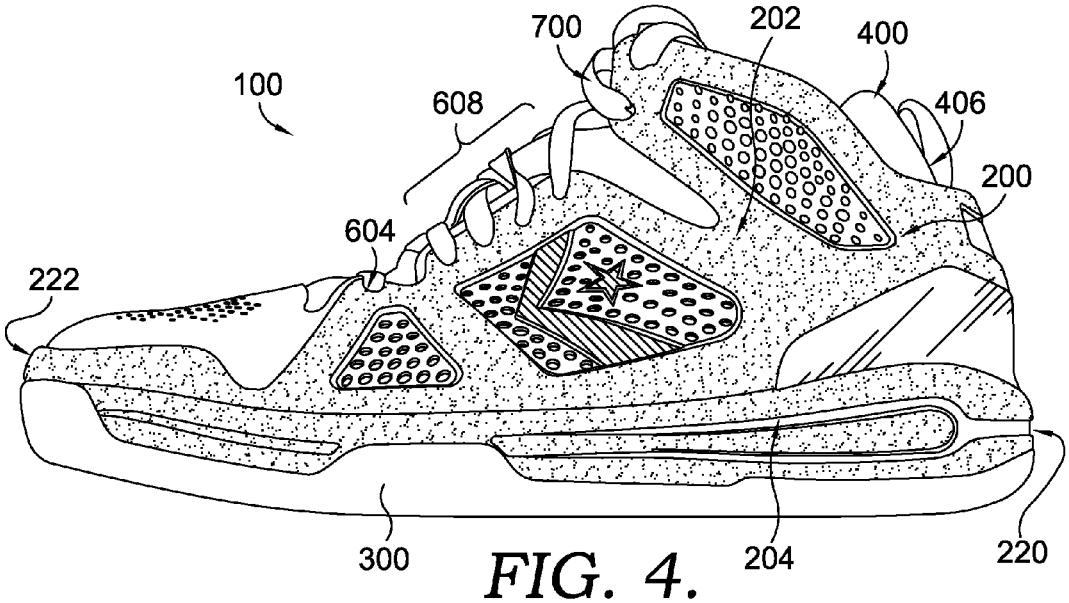
FIG. 4 depicts a lateral view of an exemplary shoe constructed with a midsole-upper, in accordance with an embodiment of the present invention.

Returning to the midsole-upper 200, an exemplary embodiment of the present invention includes one or more ventilation voids 224. The ventilation voids may be formed into any portion of the midsole-upper 200. For example, as depicted in FIGS. 1 and 2, ventilation voids 224 may be located on either the medial side 206 and/or the lateral side 208 along the upper portion 202. The ventilation voids may provide several functional aspects. For example, the ventilation voids 224 may reduce the weight of the midsole-upper 200 through a reduction in material. The ventilation voids 224 may be strategically placed, such as that which is depicted in FIGS. 1 and 2, to optimize ventilation from the inside of the shoe 100 to the outside of the shoe 100 (or vice versa). Further, the voids may provide a "window" or area to perceive the underlying bootie 400, which may help identify a particular team or position of a wearer as distinguished by a style or color of the bootie 400 visible through the ventilation voids 224.

Traditionally, materials suitable for use as both a midsole and an upper may not have performed well in both functions. For example, a level of impact attenuation desired by a midsole material may not provide a desired resistance to deformation caused by a lacing structure. Consequently, when a shoe lace extends through an aperture (e.g., eyelet, void, hole) of the upper (as is customary for a lace-up shoe), the lace may tear or rip the upper material when the lace is tightened. Therefore, having a material that is suitable for both an upper and a midsole while providing desired characteristics for both the upper and the midsole provides a challenge for a crisscross lacing shoe desiring to have a unitary upper and midsole configuration.

Figure 6:
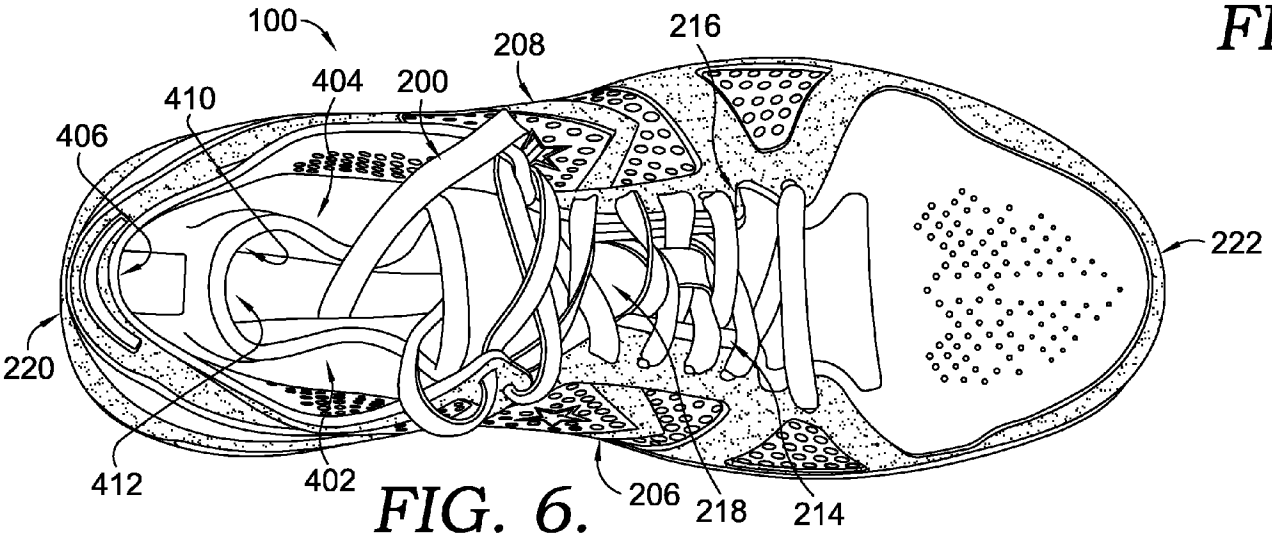
FIG. 6 depicts a top view of an exemplary shoe constructed with a midsole-upper, in accordance with an embodiment of the present invention.
Figure 7:
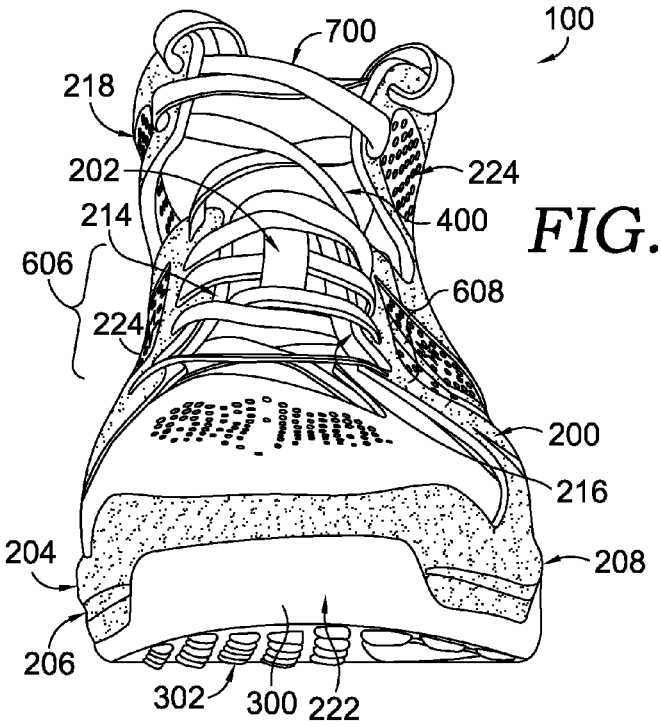
FIG. 7 depicts a toe-end view of an exemplary shoe constructed with a midsole-upper, in accordance with an embodiment of the present invention.
Figure 8:
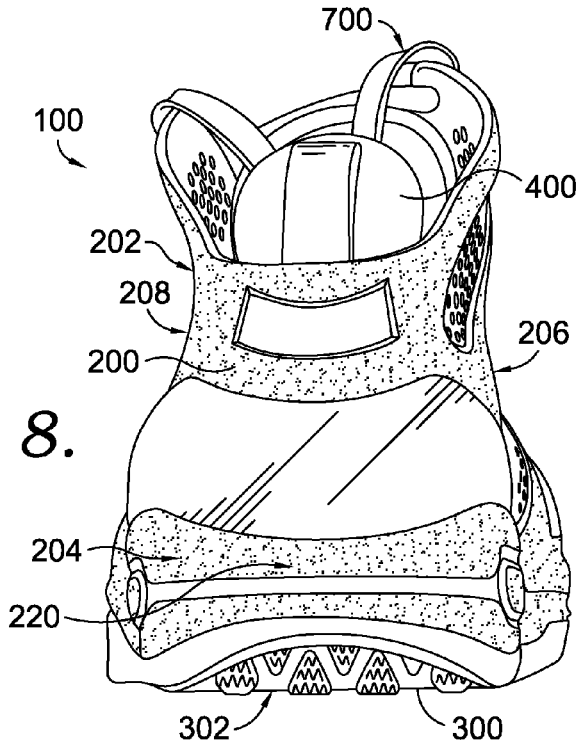
FIG. 8 depicts a heel-end view of an exemplary shoe constructed with a midsole-upper, in accordance with an embodiment of the present invention.
Figure 9:
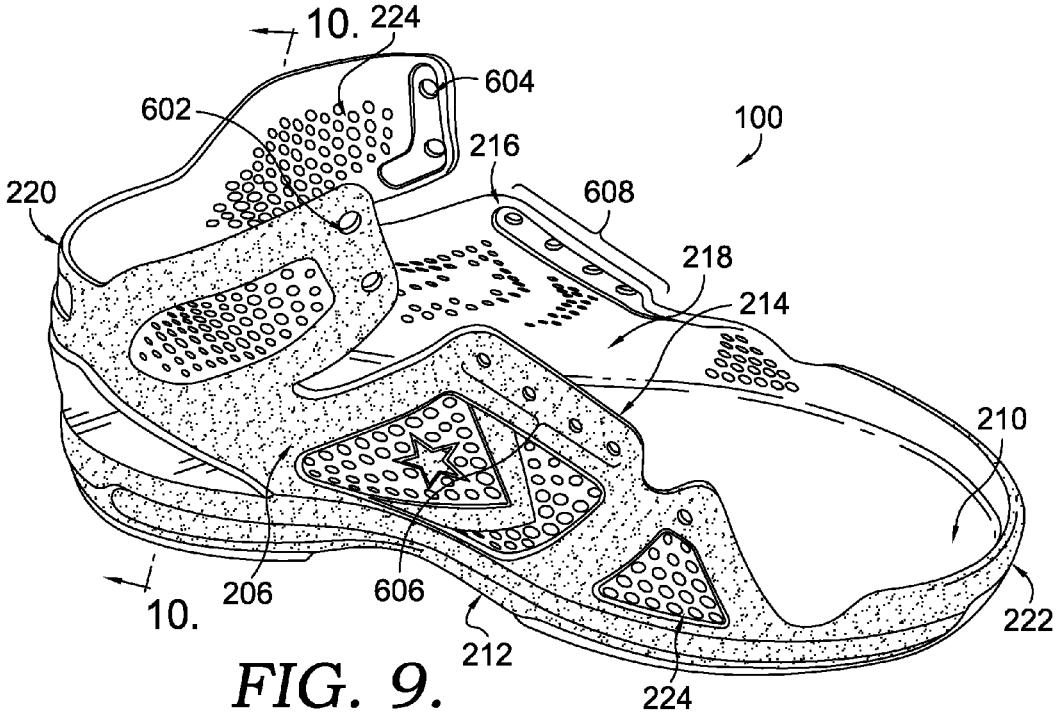
FIG. 9 depicts a perspective view of an exemplary midsole-upper shown without a bootie and a toe box, in accordance with an embodiment of the present invention.

As is typical of a crisscross lacing shoe, the shoe 100 provides a plurality of apertures extending along both the medial side edge 214 and the lateral side edge 216, as best seen in FIG. 6. A first set of apertures 602 along the medial side edge 214 are depicted in FIG. 1. A particular subset of the first set of apertures 602 includes a portion mid-length along the medial side edge 214, which are referred to herein as the medial arch apertures 606 (as best seen in FIG. 9). Similarly positioned on the lateral side, at a mid-length location along the lateral side edge 216, are a plurality of apertures referred to herein as the lateral arch apertures 608. Both the medial and the lateral arch apertures (606 and 608) are usable with a lacing structure to secure the shoe 100 securely above an arch of a wearer's foot. In an exemplary embodiment, the lacing structure 700 crisscrosses between the medial arch apertures 606 and the lateral arch apertures 608, but when a wearer exerts force on the shoe 100 (e.g., a jumping movement), the lacing structure proximate the medial arch apertures 606 and the lateral arch apertures 608 may experience a significant force causing lasting/permanent deformation (e.g., ripping, tearing, permanent stretching). Consequently, additional reinforcement may be desired in conjunction with one or more apertures of the midsole-upper 200.

Exemplary embodiments of the present invention incorporate one or more reinforcements 500 in conjunction with the lacing structure 700 and the apertures 600. For example, the reinforcements 500 may be coupled with/to the bootie 400. Or, in another example, the reinforcements 500 may be coupled with/to the midsole-upper 200. Additionally, it is contemplated that the reinforcements 500 are independent from the midsole-upper 200 and/or the bootie 400. Therefore, it is contemplated that the reinforcement(s) 500 are coupled to any combination (or neither) of the midsole-upper 200 and/or the bootie 400.

Figure 11:
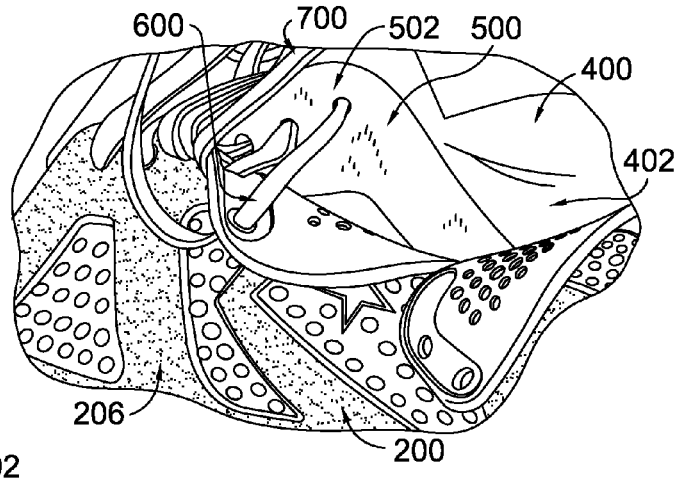
FIG. 11 depicts a partial medial view of an exemplary shoe constructed with a midsole-upper and a reinforcement coupled to a bootie, in accordance with an embodiment of the present invention.
Figure 12:
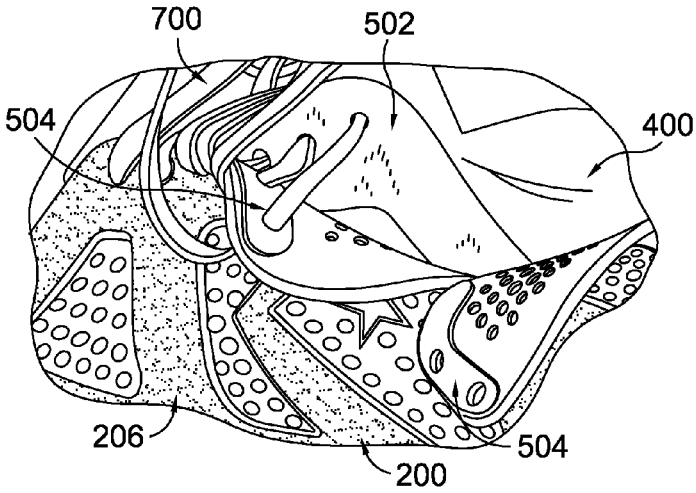
FIG. 12 depicts a partial medial view of an exemplary shoe constructed with a midsole-upper, a first reinforcement coupled to a bootie, and a reinforcement coupled to the midsole-upper, in accordance with an embodiment of the present invention.
Figure 13:
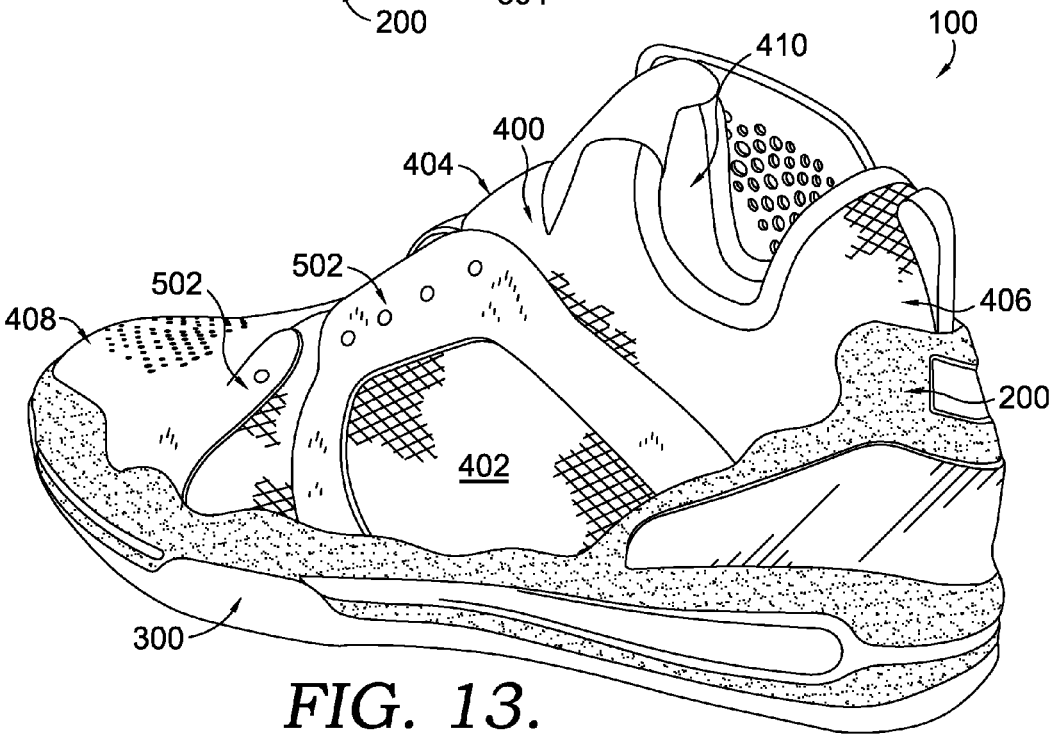
FIG. 13 depicts a medial perspective view of an exemplary shoe constructed with a bootie and a reinforcement with portions of a midsole-upper removed for illustrative purposes, in accordance with an embodiment of the present invention.

FIGS. 11, 12, and 13 depict various embodiments of contemplated reinforcements 500. FIG. 11 depicts a medial side 206 view of the shoe 100 having a reinforcement 500 coupled to the bootie 400. While reinforcement may be generally referred to as the reinforcement 500 herein, a reinforcement attached to the bootie will be referred to specifically as a bootie reinforcement 502. Similarly, a reinforcement coupled to/with the midsole-upper 200 is specifically referred to as a midsole-upper reinforcement 504 (as seen in FIG. 12).

FIG. 13 provides a view of the shoe 100 having a portion of the midsole-upper 200 removed (for illustrative purposes) to expose the medial side 402 of the bootie 400. In an exemplary embodiment, the bootie reinforcement 502 is constructed from a flexible material. For example, the bootie reinforcement 502 may be constructed from leather (synthetic or natural); however, other flexible materials are contemplated. The bootie reinforcement 502, in the example illustrated in FIG. 13, extends upwardly from the midsole portion 204 (or even from the outsole 300) along the bootie 400 to a position proximate to where the forefoot opening 218 would be located had the midsole-upper 200 not be removed for illustrative purposes. The bootie reinforcement 502 may include one or more apertures that correspond with one or more of the apertures 600 of the midsole-upper 200. For example, it is contemplated that the bootie reinforcement 502 includes an aperture (or other lace structure receiving component) at a position proximate to each of the apertures 600 of the midsole-upper 200. In particular, it is contemplated that the bootie reinforcement 502 includes an aperture coinciding with each of the medial arch apertures 606 and the lateral arch apertures 608 discussed previously.

Further, it is contemplated that the toe box 800 may comprise one or more reinforcements 500. For example, as illustrated in FIG. 13, the toe box 800 is coupled to the bootie 400 and includes a reinforcement 500, which results in the toe box 800 including reinforcement 502 as part of the toe box 800.

The bootie reinforcement 502 may be coupled to the bootie 400 utilizing an adhesive, stitching, or other mechanical connections. The bootie reinforcement 502 may be coupled to the bootie 400 along any portion covered by the bootie reinforcement 502. In an exemplary embodiment, the bootie reinforcement 502 is coupled to the bootie 400 in all locations other than a portion of the bootie reinforcement 502 parallel to the medial side edge 214 or the lateral side edge 216, which would allow the lacing structure to pass through the apertures 600 of the midsole-upper and the apertures (or other lace receiving components) of the bootie reinforcement 502. Stated differently, it is contemplated that the bootie reinforcement 502 is coupled to the bootie 400 at locations other than proximate the one or more apertures of the bootie reinforcement 502.

As previously indicated, it is contemplated that the reinforcements 500 may be coupled to the midsole-upper 200. FIG. 12 depicts an exemplary embodiment of the present invention utilizing the midsole-upper reinforcement 504. The midsole-upper reinforcement 504 may be constructed from a variety of materials, such as thermoplastic polyurethane ("TPU"), polyolefin, nylon, etc. The midsole-upper reinforcement 504 may be a strip of material shaped to be received within a formation of the midsole-upper 200 proximate the apertures 600. Additionally, it is contemplated that the midsole-upper reinforcement 504 may be an individual portion of material shaped to be received within a formation of the midsole-upper 200 proximate a specific aperture 600. The midsole-upper reinforcement 504 may serve as a washer-type device to spread force of a lacing structure over a greater surface area than if the midsole-upper reinforcement 504 was absent. Consequently, if a load is applied to an aperture 600 of the midsole-upper 200, the midsole-upper reinforcement 504 prevents lasting deformation that could otherwise occur to the aperture 600.

In an exemplary embodiment, midsole-upper reinforcement 504 may be utilized in conjunction with the bootie reinforcement 502 to achieve results discussed herein. Additionally, it is contemplated that midsole-upper reinforcement 504 may be utilized in conjunction with specific apertures 600 of the midsole-upper (e.g., proximate the ankle opening) while the bootie reinforcement 502 is utilized proximate to other apertures 600 (e.g., proximate medial and lateral arch apertures 606 and 608 respectively). Other combinations of location and reinforcement types are contemplated to be within the scope of the present invention.

Utilization of a reinforcement 500 allows for the shoe 100 to utilize a crisscross lacing pattern with the lacing structure 700. Consequently, the lacing structure 700, in an exemplary embodiment, does not surround the midsole portion 204 of the midsole-upper 200. For example, to prevent deformation of the apertures 600 without reinforcement 500, the lacing structure 700 may extend (from top to bottom) around the midsole-upper 200 as opposed to crossing back across the forefoot opening 218. The lacing structure 700 may therefore pass between the outsole 300 and the midsole portion 204 to avoid providing a crisscross pattern. Therefore, it is contemplated that utilization of the reinforcement 500 allows the lacing structure to crisscross the forefoot opening 218 without surrounding (circumnavigating) the midsole portion 204 or even contacting either the midsole portion 204 or the outsole 300.

The bootie 400, in an exemplary embodiment, is constructed from a flexible material, such as a woven mesh-like material. However, it is contemplated that the bootie 400 is constructed from any number of materials used for sock-like liners. For example, cotton, synthetic fibrous materials, leather, and the like may be used to construct the bootie 400 in part or in whole. The bootie may includes a medial side 402, a lateral side 404, a heel end 406, a toe end 408, an inner surface 410, the interior surface 412, and the inferior surface 414. It is contemplated that while the bootie 400 has a toe end 408, the bootie 400 may not have an enclosed toe. For example, the bootie 400 may extend toward the toe end 222 of the midsole-upper 200 without completely enclosing an area to be received by a foot. Instead, in an exemplary embodiment, the toe end 408 extends toward the toe box 800, which then encloses the foot. However, it is also contemplated that the bootie 400 may be a sock-like liner that encloses the foot from the ankle to a distal point.

Construction of a Shoe Having a Midsole-Upper

The shoe 100 is an exemplary shoe having a midsole-upper 200. Construction of the shoe 100 may include injection molding a midsole-upper 200 so that both the upper portion 202 and the midsole portion 204 are formed in a common injection molding process. For example, as previously discussed, EVA may be utilized to form the midsole-upper 200. In this example, EVA may not provide the resilience desired for use as the perimeter of one or more apertures, at least alone. Consequently, one or more reinforcements 500 may be included in the construction of the shoe 100 to facilitate a crisscross lacing structure such as that depicted in the figures.

As previously discussed, it is contemplated that an exemplary construction of a shoe having reinforcements 500 may include reinforcements coupled to the bootie 400. In this example, a material such as leather may provide desired characteristics to resist deformation of the apertures 600 of the midsole-upper 200. The bootie reinforcement 502 may be coupled utilizing an adhesive and stitching combination to the bootie 400. However, an upper most portion of the bootie reinforcement 502 (proximate apertures of the bootie reinforcement 502) may be left free of the bootie 400 to allow flexibility and alignability with the apertures 600. Further yet, it is contemplated that in an exemplary embodiment that utilization of a bootie reinforcement 502 also provides a function of supporting the bootie and maintaining a position of the bootie 400 within the midsole-upper 200.

Also as previously discussed, it is contemplated that the reinforcement 500 is coupled to the midsole-upper 200 during the construction of the shoe 100. For example, as depicted in FIG. 12, the midsole-upper reinforcement 504 is positioned near both a medial arch aperture 606 and an aperture near the ankle opening.

An outsole 300, such as a rubber outsole, may be coupled to the inferior surface of the midsole-upper 200. The outsole 300, as previously discussed, may be a material (e.g., rubber) that is different from the material of the midsole-upper 200 (e.g., EVA).

A lining of flexible material may be affixed to the interior surfaces of the midsole-upper 200. For example, it is contemplated that a mesh-like material having a smaller stretch coefficient than the midsole-upper 200 is adhered to the inner surface of the midsole-upper 200 at location at which stretch of the midsole-upper 200 is desired to be reduced. For example, along an interior medial side and an interior lateral side of the midsole-upper 200 a low-stretch woven material may be adhered.

Consequently, the midsole-upper 200, the outsole 300, and a lining may be coupled as discussed above to form a shell as similarly depicted in FIG. 9 (less the lining). The toe box 800, a vamp, and the bootie 400 may be coupled to the midsole-upper 200 to form the shoe 100. The bootie 400 may be stitched or affixed to a back collar area of the midsole-upper 200 to secure the bootie 400 proximate the heel end 220. Additionally, if the reinforcement 500 extends downwards toward the midsole portion 204, the reinforcement may be coupled to the midsole-upper 200 at the midsole portion 204, the upper portion 202, and/or an insert of the shoe 100.

Embodiments contemplate the midsole-upper 200 being formed from a first material, the outsole 300 being formed from a second material, the bootie 400 being formed from a third material, and the reinforcements 500 being formed from a fifth material. It is also contemplated that the midsole-upper 200 is constructed from a material different from that which is used for the outsole 300, the bootie 400, and the reinforcement 500.

In an exemplary embodiment, the reinforcement 500 is utilized when the midsole-upper is constructed from EVA, which allows for the desired flexibility and manufacturability desired for a midsole-upper, but may not provide enough resistance to permanent deformation of an aperture 600. Therefore, the reinforcement 500 constructed from TPU or leather may be utilized to allow a standard lacing pattern (e.g., crisscross) to be utilized. For a similar reason of including the reinforcement 500, the outsole 300 may be constructed from yet a different material than the midsole-upper 200, such as rubber. As previously discussed, rubber may provide desired characteristics that could not be obtained from a material that is suitable for forming the midsole-upper 200.

Although the shoe construction is described above by referring to particular embodiments, it should be understood that the modifications and variations could be made to the shoe construction described without departing from the intended scope of protection provided by the following claims.

The invention claimed is:

1. An article of footwear, comprising:

an outsole having an inferior surface for contacting the ground and a second surface opposite the inferior surface;

a midsole-upper comprising a unitary upper and midsole, the midsole-upper is formed from a flexible material having an upper portion and a midsole portion, the midsole-upper having a medial side with a first plurality of apertures proximate a top edge of the medial side, an opposite lateral side with a second plurality of apertures proximate a top edge of the lateral side, a heel end, and an opposite toe end;

the midsole portion having a superior surface and an opposite inferior surface, the inferior surface of the midsole coupled with the second surface of the outsole;

a bootie having a medial side, an opposite lateral, a heel end, an opposite toe end, an interior surface and an opposite inferior surface, the inferior surface coupled with the superior surface of the midsole-upper;

a first reinforcement member between the midsole-upper and the bootie proximate the first plurality of apertures, the first reinforcement member comprising a third plurality of apertures, the third plurality of apertures aligning with at least a portion of the first plurality of apertures; and a second reinforcement member between the midsole-upper and the bootie proximate the second plurality of apertures, the second reinforcement member comprising a fourth plurality of apertures, the fourth plurality of apertures aligning with at least a portion of the second plurality of apertures, the first reinforcement member and the second reinforcement member are formed from a material different from the flexible material of the midsole-upper, wherein the first reinforcement member and the second reinforcement member prevent a lacing structure that extends through the first aperture and the second aperture from permanently deforming the first aperture or the second aperture.

2. The article of footwear of claim 1, wherein the flexible material of the midsole-upper is ethyl vinyl acetate.

3. The article of footwear of claim 1, wherein the midsole-upper further comprises a plurality of ventilation voids formed into the lateral side and the medial side.

4. The article of footwear of claim 3, wherein the bootie is visible through one or more of the plurality of ventilation voids.

5. The article of footwear of claim 1, wherein the inferior surface of the midsole-upper and the inferior surface of the outsole provide a ground contacting surface of the article of footwear.

6. The article of footwear of claim 1, wherein the first reinforcement member and the second reinforcement member are coupled to the bootie.

7. The article of footwear of claim 1, wherein the bootie is formed from a flexible woven material.

8. The article of footwear of claim 1, wherein the material of the first reinforcement member and the second reinforcement member are synthetic leather or natural leather.

9. The article of footwear of claim 1, wherein the first reinforcement member is coupled to the lateral side of the midsole-upper and the second reinforcement member is coupled to the medial side of the midsole-upper.

10. The article of footwear of claim 9, wherein the material of the first reinforcement member and the second reinforcement member is a TPU.

11. The article of footwear of claim 1, wherein the lacing structure does not surround the midsole portion of the midsole-upper.

12. An article of footwear, comprising:

a midsole-upper comprising a unitary upper and midsole of a first flexible material having a medial side, a lateral side, a toe end, and a heel end;

the midsole-upper has an upper portion and a midsole portion, wherein the upper portion is formed to surround a medial and a lateral portion of a received foot, the midsole portion has a superior surface formed to provide a support platform for the foot and the midsole portion has an opposite inferior surface;

the medial side of the midsole-upper comprising a first plurality of apertures and the lateral side of the midsole-upper comprising a second plurality of apertures;

an outsole of a second flexible material having a top surface contacting the inferior surface of the midsole-upper, and an opposite bottom surface adapted as a contacting the ground;

a bootie of a third flexible material, such that the second flexible material is different from the first flexible material, the bootie coupled to the midsole-upper proximate the heel end of the midsole-upper;

a medial reinforcement member proximate at least a portion of the first plurality of apertures, the medial reinforcement member comprising a third plurality of apertures aligning with at least a portion of the first plurality of apertures and a lateral reinforcement member along at least a portion of the second plurality of apertures, the lateral reinforcement member comprising a fourth plurality of apertures aligning with at least a portion of the second plurality of apertures, the medial reinforcement member and the lateral reinforcement member being comprised of a fourth material, such that the fourth material is different from the first flexible material; and a lacing structure being able to extend across a forefoot opening between the medial side of the midsole-upper and the lateral side of the midsole-upper, wherein the lacing structure is able to extend through the medial side of the midsole-upper, the medial reinforcement, the lateral reinforcement and the lateral side of the midsole-upper.

13. The article of footwear of claim 12, wherein the first flexible material is ethyl vinyl acetate.

14. The article of footwear of claim 12, wherein the upper portion and the midsole portion of the midsole-upper are injection molded as a cohesive component.

15. The article of footwear of claim 12 further comprising an outsole of a flexible material that is different from the first flexible material, the outsole coupled to the inferior surface of the midsole portion of the midsole-upper.

16. The article of footwear of claim 12, wherein the bootie is coupled to the midsole-upper utilizing stitches or an adhesive.

17. The article of footwear of claim 12, wherein the medial reinforcement member and the lateral reinforcement member are coupled to the bootie.

18. The article of footwear of claim 12, wherein the medial reinforcement member and the lateral reinforcement member are coupled to the midsole-upper.

19. The article of footwear of claim 12, wherein the lacing structure does not contact the midsole portion or the outsole portion.

20. An article of footwear comprising:

a midsole-upper comprising a unitary upper and midsole of a molded material having a toe end and an opposite heel end, and having opposite medial and lateral sides extending between the toe end and the heel end, the medial side extends upwardly from a midsole portion to form a medial side edge, and the lateral side extends upwardly from the midsole portion to form a lateral side edge, such that the medial side edge and the lateral side edge define a forefoot opening, wherein the medial side includes a first set of apertures extending along a portion of the medial side edge, and the lateral side includes a second set of apertures extending along a portion of the lateral side edge, the midsole-upper having an inner surface and an opposite outer surface;

a bootie of a flexible material having an inner surface and an opposite outer surface, the outer surface of the bootie and the inner surface of midsole-upper are coupled proximate the midsole-upper heel end, and the bootie extending across the forefoot;

a medial reinforcement member positioned between the outer surface of the bootie and the inner surface of the midsole-upper comprising a third plurality of apertures aligning with at least a portion of the first set of apertures of the midsole-upper;

a lateral reinforcement member positioned between the outer surface of the bootie and the inner surface of the midsole-upper comprising a fourth plurality of apertures aligning with at least a portion of the second set of apertures of the midsole-upper, wherein the medial reinforcement and the lateral reinforcement are a material different from the molded material of the midsole-upper; and a lacing structure crossing from the first set of apertures to the second set of apertures across the forefoot opening such that the lacing structure extends through both the medial reinforcement and the lateral reinforcement after extending through the first set of apertures and before extending through the second set of apertures.

* * * * *

UNITED STATES PATENT AND TRADEMARK OFFICE

CERTIFICATE OF CORRECTION

PATENT NO. : 8,595,957 B2
APPLICATION NO. : 12/983573
DATED : December 3, 2013
INVENTOR(S) : Sean Michael McDowell and Christopher L. Edington It is certified that error appears in the above-identified patent and that said Letters Patent is hereby corrected as shown below:

In the claims
Claim 1, column 10, line 38, “midsole” should read --midsole portion--.
Claim 1, column 10, line 40, “lateral” should read --lateral side--.
Claim 9, column 11, line 17, “lateral” should read --medial--.
Claim 9, column 11, line 20, “medial” should read --lateral--.
Claim 12, column 11, line 44, “second” should read --third--.

Signed and Sealed this
Twenty-second Day of December, 2015

Michelle K. Lee

Michelle K. Lee
*Director of the United States Patent and Trademark Office*